US006644314B1

(12) United States Patent
Elsberg

(10) Patent No.: US 6,644,314 B1
(45) Date of Patent: Nov. 11, 2003

(54) EXTENSIBLE AND RETRACTABLE FACE MASK

(75) Inventor: Laura L. Elsberg, Woodstock, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/715,447

(22) Filed: Nov. 17, 2000

(51) Int. Cl.[7] ..... A62B 18/02

(52) U.S. Cl. ..... 128/206.21; 128/205.27

(58) Field of Search ..... 128/201.23–201.25, 128/201.28, 205.25, 205.27, 205.28, 206.12–206.15, 206.17–206.19, 857, 549, 888; 604/308; 2/2.11, 2.16, 9

(56) References Cited

U.S. PATENT DOCUMENTS

| | | | | | |
|---|---|---|---|---|---|
| 4,443,513 | A | * | 4/1984 | Meitner et al. | 264/288.8 |
| 4,628,927 | A | | 12/1986 | Ward | |
| 4,720,415 | A | * | 1/1988 | Vander Wielen et al. | 156/163 |
| 4,827,923 | A | | 5/1989 | Bishop et al. | |
| 4,846,170 | A | * | 7/1989 | McAnalley et al. | 128/207.13 |
| 5,035,240 | A | | 7/1991 | Braun et al. | |
| 5,114,781 | A | * | 5/1992 | Morman | 428/152 |
| 5,244,482 | A | * | 9/1993 | Hassenboehler et al. | 55/528 |
| 5,306,545 | A | * | 4/1994 | Shirayanagi et al. | 128/206.12 |
| 5,467,765 | A | * | 11/1995 | Maturaporn | 128/206.19 |
| 5,486,411 | A | | 1/1996 | Hassenboehler, Jr. et al. | |
| 5,540,976 | A | | 7/1996 | Shawver et al. | |
| 5,553,608 | A | | 9/1996 | Reese et al. | |
| 5,645,057 | A | * | 7/1997 | Watt et al. | 128/206.12 |
| 5,656,368 | A | * | 8/1997 | Braun et al. | 128/206.12 |
| 5,681,645 | A | * | 10/1997 | Strack et al. | 128/206.18 |
| 5,694,925 | A | | 12/1997 | Reese et al. | |
| 5,699,791 | A | | 12/1997 | Sukiennik et al. | |
| 5,699,792 | A | | 12/1997 | Reese et al. | |
| 5,701,892 | A | | 12/1997 | Bledstein | |
| 5,706,804 | A | * | 1/1998 | Baumann et al. | 128/206.12 |
| 5,765,556 | A | * | 6/1998 | Brunson | 128/206.19 |
| 5,883,026 | A | * | 3/1999 | Reader et al. | 128/206.12 |
| 5,934,275 | A | * | 8/1999 | Gazzara | 128/205.27 |
| 6,123,077 | A | * | 9/2000 | Bostock et al. | 128/206.12 |
| 6,148,817 | A | * | 11/2000 | Bryant et al. | 128/206.19 |
| 6,332,465 | B1 | * | 12/2001 | Xue et al. | 128/205.25 |
| 6,394,090 | B1 | * | 5/2002 | Chen et al. | 128/206.12 |

FOREIGN PATENT DOCUMENTS

| | | |
|---|---|---|
| EP | 0341874 A2 | 11/1989 |
| WO | WO9108829 | 6/1991 |
| WO | WO9638620 | 12/1996 |
| WO | 9833403 | 8/1998 |
| WO | WO 02/41717 A2 * | 5/2002 |

OTHER PUBLICATIONS

Written Opinion, Oct. 28, 2002.
International Search Report, Sep. 5, 2002.
International Preliminary Examination Report, Feb. 5, 2003.

* cited by examiner

*Primary Examiner*—Weilun Lo
*Assistant Examiner*—Teena Mitchell
(74) *Attorney, Agent, or Firm*—Dority & Manning, P.A.

(57) ABSTRACT

There is provided a face mask having a mask portion that is extensible and retractable in at least one direction to improve the overall comfort and fit of the mask. The mask portion may be a composite of several materials or layers joined by any conventional process, provided that the composite is extensible and retractable. At least one of the materials and/or layers has properties of stretch and recovery that are imparted to the mask portion to render the mask portion extensible and retractable overall.

20 Claims, 1 Drawing Sheet

EXTENSIBLE AND RETRACTABLE FACE MASK

FIELD OF THE INVENTION

The present invention relates to faces masks having improved comfort characteristics.

BACKGROUND

Wearing protective face masks of various configurations has become standard procedure in the health care and other related fields. The use of a face mask is important to protect both the patient and the health care practitioner. In addition, many industrial applications also require wearing protective face masks.

A vast array of face mask configurations are know to those skilled in the art. Exemplary face masks are described and shown, for example, in the following U.S. Pat. Nos. 4,802,473; 4,969,457; 5,322,061; 5,383,450; 5,553,608; 5,020,533; and 5,813,398.

Much effort has been expended on developing face masks having improved filtration and/or sealing characteristics. For example, the molded mask illustrated and described in U.S. Pat. No. 4,319,567 is especially configured to improve the seal around the edges of the mask. Pleated face mask designs have also been configured to improve the fit of the face mask, thereby attempting to reduce the passage of liquids and/or aerosols between the periphery of the mask and the wearer's face. Other designs sought to improve the seal around the wearer's face by using fluid-impervious flaps as disclosed in U.S. Pat. No. 5,553,608, and foam or adhesive tape placed around the periphery of the mask as described in U.S. Pat. No. 5,735,270.

Improvements in filtration and sealing characteristics of a mask do not necessarily result in increased comfort and fit of the mask. While some advances have been made, improvement is still desirable with respect to comfort enhancing features of face masks. For instance, a primary complaint of wearers of face masks is that use of the mask for extended periods of time results in abrasion across the face at the contact points between the face mask and the wearer's skin, and more particularly, along the periphery of the mask. Such abrasion leads to chaffing and redness accompanied by discomfort. Thus, there exists a need for a face mask that maintains barrier properties while providing improved comfort to the wearer.

SUMMARY OF THE INVENTION

Objects and advantages of the invention will be set forth in part in the following description, or may be obvious from the description, or may be learned through practice of the invention.

The present invention relates to a face mask that provides enhanced comfort to the wearer while maintaining its barrier properties. The invention is not limited to any particular style or configuration of face mask, and includes rectangular masks, pleated masks, duck bill masks, cone masks, trapezoidal masks, etc. It should be appreciated that the benefits of the present invention can be incorporated into a variety of face mask configurations.

In accordance with the invention, the mask portion of the face mask includes at least one material having stretch and recovery characteristics so that the mask portion overall is extensible and retractable in one or more directions. A mask portion that is extensible and retractable in at least two directions is able to stretch across the face of the wearer from ear to ear and from nose to chin. This ability to extend and retract creates a better seal around the periphery of the mask portion and a more comfortable fit for the wearer.

The mask portion may be sized to fit over the nose, mouth, and/or cheeks of the wearer as desired. For example, with a generally rectangular mask, the mask portion has a top edge and a bottom edge, with the top edge adapted to fit over the nose and cheeks of the wearer and the bottom edge adapted to extend under the chin of the wearer. The mask portion may be a composite of several layers, at least one of which imparts the desired extensible and retractable characteristics to the mask portion.

The mask portion may include an outer layer, a layer having stretch and recovery characteristics (the "stretch and recovery" layer), a filtration layer, and an inner layer. The layers of the mask portion may be constructed from various conventional materials. For example, the inner layer and the outer layer may be a nonwoven material, such as a spunbonded, meltblown, or coform nonwoven web or a bonded carded web. The nonwoven material may be a necked material or a reversibly necked material. The inner layer and the outer layer may be made of the same material or different materials. The filtration layer may be a meltblown nonwoven web, and may more particularly be an electret. The filtration layer may alternatively be an expanded polytetrafluoroethylene membrane. In some embodiments, the filtration layer may have stretch and recovery characteristics, eliminating the need for an additional stretch and recovery layer. The layers of the composite may be joined by various methods, including adhesive bonding, stitchbonding, thermal bonding, or ultrasonic bonding, provided that the resulting composite is extensible and retractable.

The stretch and recovery layer may be one or a combination of suitable materials, such as a necked nonwoven web, a reversibly necked nonwoven web, and elastic materials including an elastic coform material, an elastic meltblown nonwoven web, a plurality of elastic filaments, an elastic film, or any combination thereof.

In some embodiments, resilient strips of material may be attached to and extend along each edge of the extensible and retractable mask portion for use in securing the mask to the wearer's face and to provide an enhanced fluid seal between the periphery of the mask portion and the wearer's face. The strips may be made of a material that is extensible and retractable to enhance the fit and comfort of the extensible and retractable mask portion.

The present invention may include any manner of element, such as ear loops, a continuous loop, surgical-style tie fasteners, or other elements for securing the mask to the face of the wearer. The securing element may be constructed of extensible and retractable material if desired. Where the mask incorporates resilient edge strips, the tie fasteners, ear loops, or other suitable securing elements may be attached to the respective resilient edge strips adjacent to each side of the mask portion.

A face mask in accordance with the present invention can incorporate any combination of known face mask features. For example, the mask portion may include an elongated malleable member disposed to allow configuring the top edge to closely fit the contours of the nose and cheeks of the wearer. Likewise, the face mask may have any configuration of an eye shield or visor. Further, the face mask may include a beard cover disposed to completely contain the beard of the wearer.

An extensible and retractable filtration composite particularly suited for face mask applications is also within the scope of the present invention. The filtration composite may be a composite of multiple layers or a composite of multiple materials in a single layer. In a multiple layer composite embodiment, the composite may include an outer nonwoven web layer, a stretch and recovery layer (which may be a filtration layer as well), and an inner nonwoven web layer. The stretch and recovery layer may be any material that possess sufficient stretch and recovery characteristics to impart the desired degree of "extensible and retractable" to the composite overall, including an elastic coform material, an elastic meltblown nonwoven web, a plurality of elastic filaments, an elastic film, or a combination thereof. The layers of the composite are joined such that the stretch and recovery layer imparts its properties to the overall composite.

DEFINITIONS

As used herein, the term "nonwoven fabric or web" means a web having a structure of individual fibers or threads which are interlaid, but not in an identifiable repeatable manner as in a knitted fabric. Nonwoven fabrics or webs have been formed from various processes such as, for example, meltblowing processes, spunbonding processes, and bonded carded web processes. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91).

As used herein, the term "spunbonded fibers" refers to small diameter fibers which are formed by extruding molten thermoplastic material as filaments from a plurality of fine, usually circular capillaries of a spinneret with the diameter of the extruded filaments then being rapidly reduced to fibers as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al., the contents of which are incorporated herein by reference in their entirety. Spunbond fibers are generally continuous and have diameters generally greater than about 7 microns, more particularly, between about 10 and about 20 microns.

As used herein, the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter (less than about 75 microns). Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al., the content of which is incorporated herein by reference in its entirety. Meltblown fibers may be continuous or discontinuous.

As used herein, the term "composite" refers to a material which may be a multicomponent material or a multilayer material. These materials may include, for example, stretch bonded laminates, neck bonded laminates, or any combination thereof.

As used herein, the term "stretch bonded laminate" refers to a composite material having at least two layers in which one layer is a gatherable layer and the other layer is an elastic layer. The layers are joined together at disparate points when the elastic layer is extended from its original condition so that upon relaxing the layers, the gatherable layer is gathered. Such a multilayer composite elastic material may be stretched to the extent that the nonelastic material gathered between the bond locations allows the elastic material to elongate. One type of stretch bonded laminate is disclosed, for example, by U.S. Pat. No. 4,720,415 to Vander Wielen et al., the content of which is incorporated herein by reference in its entirety. Other composite elastic materials are disclosed in U.S. Pat. No. 4,789,699 to Kieffer et al., U.S. Pat. No. 4,781,966 to Taylor and U.S. Pat. Nos. 4,657,802 and 4,652,487 to Morman and U.S. Pat. No. 4,655,760 to Morman et al., the contents of which are incorporated herein by reference in their entirety.

As used herein, the terms "necking" or "neck stretching" interchangeably refer to a method of elongating a nonwoven fabric, generally in the machine direction, to reduce its width (cross-machine direction) in a controlled manner to a desired amount. The controlled stretching may take place under cool, room temperature or greater temperatures and is limited to an increase in overall dimension in the direction being stretched up to the elongation required to break the fabric, which in most cases is about 1.2 to 1.6 times. When relaxed, the nonwoven fabric retracts toward, but does not return to, its original dimensions such that it is narrower in the cross machine direction. Such a process is disclosed, for example, in U.S. Pat. No. 4,443,513 to Meitner and Notheis, U.S. Pat. Nos. 4,965,122, 4,981,747 and 5,114,781 to Morman and U.S. Pat. No. 5,244,482 to Hassenboehler Jr. et al., the contents of which are incorporated herein by reference in their entirety.

As used herein, the term "necked material" refers to any material which has undergone a necking or neck stretching process.

As used herein, the term "reversibly necked material" refers to a material that possesses stretch and recovery characteristics formed by necking a material, then heating the necked material, and cooling the material. Such a process is disclosed in U.S. Pat. No. 4,965,122 to Morman, commonly assigned to the assignee of the present invention, and incorporated by reference herein in its entirety.

As used herein, the term "neck bonded laminate" refers to a composite material having at least two layers in which one layer is a necked, non-elastic layer and the other layer is an elastic layer. The composite is formed by joining the layers while the non-elastic layer is in a necked condition. Examples of neck-bonded laminates are such as those described in U.S. Pat. Nos. 5,226,992, 4,981,747, 4,965,122 and 5,336,545 to Morman, the contents of which are incorporated herein by reference in their entirety.

As used herein, the term "coform" means a meltblown material to which at least one other material is added during the meltblown material formation. The meltblown material may be made of various polymers, including elastomeric polymers. Various additional materials may be added to the meltblown fibers during formation, including, for example, pulp, superabsorbent particles, cellulose or staple fibers. Coform processes are illustrated in commonly assigned U.S. Pat. No. 4,818,464 to Lau and U.S. Pat. No. 4,100,324 to Anderson et al., the contents of which are incorporated herein by reference in their entirety.

As used herein, the term "stitchbonded" refers to a process in which materials (fibers, webs, films, etc.) are joined by stitches sewn or knitted through the materials. Examples of such processes are illustrated in U.S. Pat. No.

4,891,957 to Strack et al. and U.S. Pat. No. 4,631,933 to Carey, Jr, the contents of which are incorporated herein by reference in their entirety.

As used herein, the term "ultrasonic bonding" refers to a process in which materials (fibers, webs, films, etc.) are joined by passing the materials between a sonic horn and anvil roll. An example of such a process is illustrated in U.S. Pat. No. 4,374,888 to Bornslaeger, the content of which is incorporated herein by reference in its entirety.

As used herein, the term "thermal point bonding" involves passing materials (fibers, webs, films, etc.) to be bonded between a heated calender roll and an anvil roll. The calender roll is usually, though not always, patterned in some way so that the entire fabric is not bonded across its entire surface, and the anvil roll is usually flat. As a result, various patterns for calender rolls have been developed for functional as well as aesthetic reasons. Typically, the percent bonding area varies from around 10 percent to around 30 percent of the area of the fabric laminate. As is well known in the art, thermal point bonding holds the laminate layers together and imparts integrity to each individual layer by bonding filaments and/or fibers within each layer.

As used herein, the term "elastic" refers to any material, including a film, fiber, nonwoven web, or combination thereof, which upon application of a biasing force, is stretchable to a stretched, biased length which is at least about 150 percent, or one and a half times, its relaxed, unstretched length, and which will recover at least 15 percent of its elongation upon release of the stretching, biasing force.

As used herein, the term "extensible and retractable" refers to the ability of a material to extend upon stretch and retract upon release. Extensible and retractable materials are those which, upon application of a biasing force, are stretchable to a stretched, biased length between 100 percent and about 150 percent of their unstretched length and which will recover a portion, preferably at least about 15 percent, of their elongation upon release of the stretching, biasing force.

As used herein, the terms "elastomer" or "elastomeric" refer to polymeric materials that have properties of stretchability and recovery.

As used herein, the term "stretch" refers to the ability of a material to extend upon application of a biasing force. Percent stretch is the difference between the initial dimension of a material and that same dimension after the material has been stretched or extended following the application of a biasing force. Percent stretch may be expressed as [(stretched length—initial sample length)/initial sample length]×100. For example, if a material having an initial length of one (1) inch is stretched 0.50 inch, that is, to an extended length of 1.50 inches, the material can be said to have a stretch of 50 percent.

As used herein, the term "recover" or "recovery" refers to a contraction of a stretched material upon termination of a biasing force following stretching of the material by application of the biasing force. For example, if a material having a relaxed, unbiased length of one (1) inch is elongated 50 percent by stretching to a length of one and one half (1.5) inches the material would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its elongation.

As used herein, the term "electret" or "electret treating" refers to a treatment that imparts a charge to a dielectric material, such as a polyolefin. The charge includes layers of positive or negative charges trapped at or near the surface of the polymer, or charge clouds stored in the bulk of the polymer. The charge also includes polarization charges which are frozen in alignment of the dipoles of the molecules. Methods of subjecting a material to electret treating are well known by those skilled in the art. These methods include, for example, thermal, liquid-contact, electron beam, and corona discharge methods. One particular technique of subjecting a material to electret treating is disclosed in U.S. Pat. No. 5,401,466, the contents of which is herein incorporated in its entirety by reference. This technique involves subjecting a material to a pair of electrical fields wherein the electrical fields have opposite polarities.

As used herein, the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, any given range is intended to include any and all lesser included ranges. For example, a range of from 45–90 would also include 50–90; 45–80; 46–89; and the like.

BRIEF DESCRIPTION OF THE DRAWINGS

For a more complete understanding of the present invention and for the further advantages thereof, reference is now made to the following description taken in conjunction with the accompanying drawings, in which.

DETAILED DESCRIPTION OF THE INVENTION

Reference will now be made in detail to embodiments and examples of the invention. Each example is provided by way of explanation of the invention, and not as a limitation of the invention. For example, features illustrated or described as part of one embodiment can be used with another embodiment to yield still further embodiments. It is intended that the present invention include modifications and variations to the embodiments described herein that come with the scope of the claims and equivalents thereto.

The present invention relates to any style or configuration of face mask having a mask portion that is extensible and retractable in one or more directions. The mask portion is thereby capable of stretching across the face of the wearer from ear to ear and/or from nose to chin. The ability to stretch and recover provides the mask with better sealing capabilities and a more comfortable fit. To attain such properties, it is desirable that the mask portion include at least one layer or a material having stretch and recovery properties and that these properties are imparted to the mask portion such that the overall mask portion is extensible and retractable. In certain embodiments, the percent recovery is about 15 percent and the percent stretch is between 15–65 percent, more particularly between 20–40 percent stretch, and even more particularly about 25–30 percent stretch.

Figure 1:
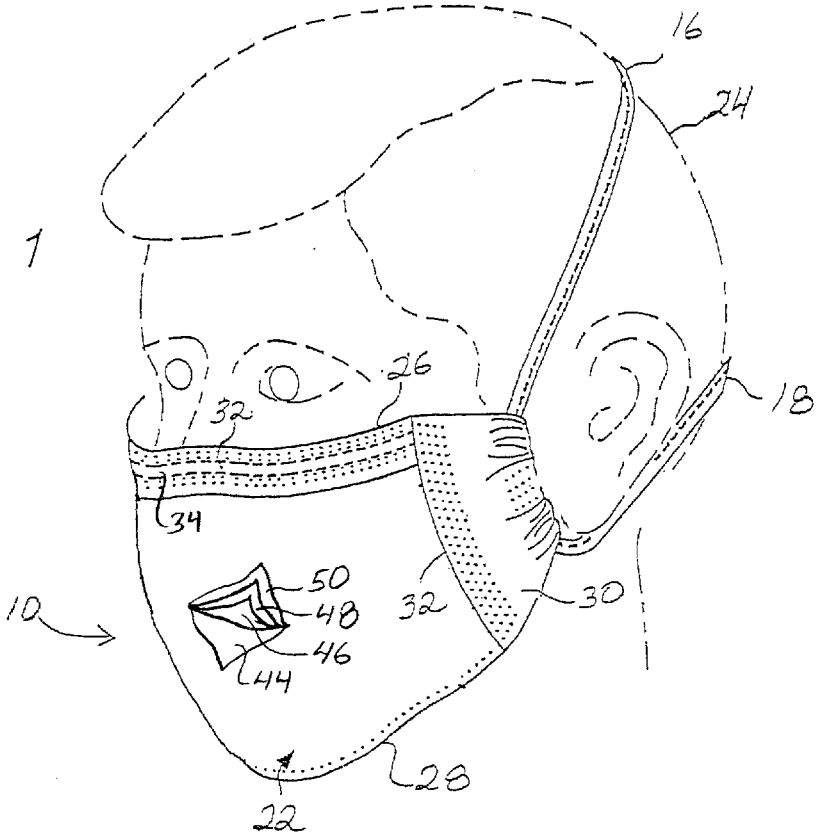
FIG. 1 is a perspective view of a generally rectangular face mask in accordance with the present invention.
Figure 2:
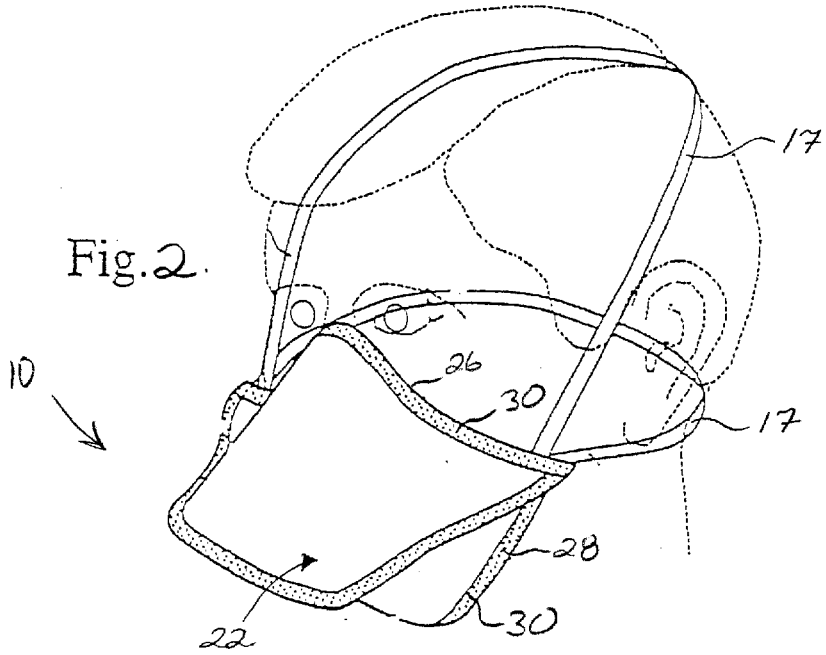
FIG. 2 is a perspective view of a trapezoidal style face mask in accordance with the present invention.

Exemplary face mask structures are illustrated in FIG. 1 (rectangular mask) and FIG. 2 (trapezoidal or "duck bill"

mask). The masks 10 include a mask portion 22 defined between an upper edge 26 and a lower edge 28. Side edges 32 also define the mask portion 22 in the rectangular mask of FIG. 1. The mask portion 22 is typically formed of a plurality of layers. The mask portion 22 may include resilient edge strips 30 to better secure the mask portion 22 to the wearer's face and to provide an enhanced fluid seal along the periphery of the mask portion. The strips 30 may be made of a material that is extensible and retractable to sustain the fit and comfort of the mask portion 22. The mask portion 22 may also include an elongated malleable member 34 (FIG. 1) disposed, for example, adjacent to the upper edge 26, to allow configuring the upper edge to closely fit the contours of the nose and cheeks of the wearer. The malleable member 34 may be made of any malleable material, including metal wire or an aluminum band.

In the illustrated embodiments, securing devices, such as conventional tie straps 16 and 18 (FIG. 1) or continuous loops 17 (FIG. 2), are utilized to secure the mask 10 over the nose and mouth of the wearer 24. The straps 16 and 18 and loops 17 are for illustrative purposes only. There are a number of different types of securing devices known to those skilled in the art that may be utilized with the present invention, including any combination of straps, loops, and the like. The only requirement is that the securing devices urge the mask portion 22 into snug engagement with the wearer's face.

As mentioned, it should be appreciated that the present invention is not limited to any particular type or style of face mask, and that the styles shown in the FIGS. are for illustrative purposes only. The extensible and retractable mask portion 22 according to this invention may be incorporated into any face mask style or configuration, including rectangular masks, pleated masks, duck bill masks, cone masks, trapezoidal masks, etc. The face mask according to the present invention may also incorporate any combination of known face mask features, such as visors or shields, beard covers, etc. Exemplary faces masks are described and shown, for example, in the following U.S. Pat. Nos. 4,802,473; 4,969,457; 5,322,061; 5,383,450; 5,553,608; 5,020,533; and 5,813,398. These patents are incorporated herein in their entirety for all purposes.

The mask portion 22 may be a composite of various layers or a composite of multiple materials in a single layer. With either embodiment, at least one of the respective layers and/or materials has stretch and recovery characteristics that give the mask portion its overall extensible and retractable capability. In the illustrated embodiment, the mask portion is a composite of layers including an outer layer 44, a "stretch and recovery" layer 46, a filtration layer 48, and an inner layer 50. The inner layer is designated herein as the layer that is nearest the face of the wearer 24. The stretch and recovery layer 46 and the filtration layer 48 may be disposed between the outer layer 44 and inner layer 50, but are not required to be arranged in any particular configuration.

It should be understood that a separate stretch and recovery layer 46 may not be needed if one of the other layers, for example the filtration layer 48, exhibits sufficient stretch and recovery characteristics to impart the desired extensible and retractable characteristics to the mask portion.

It should also be understood that if one of the layers of the mask portion is inelastic, then the layers must be joined by a process wherein the properties of the stretch and recovery layer are imparted to the overall mask portion 22.

The layers of the mask portion 22 may be constructed from various materials well know to those skilled in the art. The inner layer 50 and the outer layer 44 may be any nonwoven web, such as a spunbonded, meltblown, or coform nonwoven web or a bonded carded web. The inner layer 50 and the outer layer 44 may be a necked nonwoven web or a reversibly necked nonwoven web. The inner layer 50 and the outer layer 44 may be made of the same or different materials.

Many polyolefins are available for nonwoven web production, for example polyethylenes such as Dow Chemical's ASPUN® 6811A linear polyethylene, 2553 LLDPE and 25355, and 12350 polyethylene are such suitable polymers. Fiber forming polypropylenes include, for example, Exxon Chemical Company's Escorene® PD 3445 polypropylene and Himont Chemical Co.'s PF-304. Many other suitable polyolefins are commercially available.

The stretch and recovery layer 46 (or any other layer relied upon to impart extensible and retractable characteristics to the mask portion) may be made of any material having sufficient stretch and recovery characteristics to impart the desired degree of extension and retraction to the mask portion, including a necked nonwoven web, a reversibly necked nonwoven material and elastic materials such as an elastic coform material, an elastic meltblown nonwoven web, a plurality of elastic filaments, an elastic film, or a combination thereof. Such elastic materials have been incorporated into composites, for example, in U.S. Pat. No. 5,681,645 to Strack et al., U.S. Pat. No. 5,493,753 to Levy et al., U.S. Pat. No. 4,100,324 to Anderson et al., and in U.S. Pat. No. 5,540,976 to Shawver et al, the contents of which are incorporated herein by reference in their entirety. In an embodiment where an elastic film is used, the film must be sufficiently perforated to ensure that the wearer can breathe through the mask.

Elastomeric thermoplastic polymers useful in the practice of this invention include block copolymers having the general formula A-B-A' or A-B, where A and A' are each a thermoplastic polymer endblock which contains a styrenic moiety such as a poly (vinyl arene) and where B is an elastomeric polymer midblock such as a conjugated diene or a lower alkene polymer. Block copolymers of the A-B-A' type can have different or the same thermoplastic block polymers for the A and A' blocks, and the present block copolymers are intended to embrace linear, branched and radial block copolymers. Examples of useful elastomeric resins include those made from block copolymers such as polyurethanes, copolyether esters, polyamide polyether block copolymers, ethylene vinyl acetates (EVA), block copolymers having the general formula A-B-A' or A-B like copoly(styrene/ethylene-butylene), styrene-poly(ethylene-propylene)-styrene, styrene-poly(ethylene-butylene)-styrene, polystyrene/poly(ethylenebutylene)/polystyrene, poly(styrene/ethylene-butylene/styrene) and the like.

The filtration layer 48 may be made of a meltblown nonwoven web and, in some embodiments, may be an electret. Electret treatment results in a charge being applied to the filtration medium which further increases filtration efficiency by drawing particles to be filtered toward the filter by virtue of their electrical charge. Electret treatment can be carried out by a number of different techniques. One technique is described in U.S. Pat. No. 5,401,446 to Tsai et al. assigned to the University of Tennessee Research Corporation and incorporated herein by reference in its entirety. Other methods of electret treatment are known in the art, such as that described in U.S. Pat. No. 4,215,682 to Kubik et al., U.S. Pat. No. 4,375,718 to Wadsworth, U.S. Pat. No. 4,592,815 to Nakao and U.S. Pat. No. 4,874,659 to Ando, the contents of which are incorporated herein by reference in their entirety.

In some embodiments, the filtration layer 48 may have stretch and recovery properties, eliminating the need for an additional or separate stretch and recovery layer. For example, the filtration material may be made of an expanded polytetrafluoroethylene (PTFE) membrane, such as those manufactured by W.L. Gore & Associates. A more complete description of the construction and operation of such materials can be found in U.S. Pat. No. 3,953,566 to Gore and U.S. Pat. No. 4,187,390 to Gore, the contents of which are incorporated herein by reference in their entirety. The expanded polytetrafluoroethylene membrane may be incorporated into a multi-layer composite, including, but not limited to, an outer nonwoven web layer, an extensible and retractable layer, and an inner layer comprising a nonwoven web. The layers of the composite are joined such that the overall composite is extensible and retractable.

The present invention also encompasses the extensible and retractable filtration composite apart from the face mask. The filtration composite may be a multi-layer composite or a composite of multiple materials in a single layer. The discussion above relating to the materials and/or layers of the mask portion pertain to the filtration composite as well. For example, the multi-layer filtration composite may include at least one of stretch and recovery layer that imparts the desired extension and retraction properties to the overall filtration composite.

The multiple layers of the composite may be joined by various methods, including adhesive bonding, thermal bonding, or ultrasonic bonding, provided that the resulting composite is extensible and retractable.

In one embodiment, the composite may be a neck bonded laminate. The neck bonded laminate may utilize a necked material or a reversibly necked material. The necking process typically involves unwinding a material from a supply roll and passing it through a brake nip roll assembly at a given linear speed. A take-up roll or nip, operating at a linear speed greater than that of the brake nip roll, draws the material and generates the tension needed to elongate and neck the fabric. Where a reversibly necked material is desired, the stretched material is heated and cooled while in a stretched condition. The heating and cooling of the stretched material causes additional crystallization of the polymer and imparts a heat set. The necked material or reversibly necked material is then bonded to an elastic material stretchable in at least the cross-machine direction. The resulting necked composite is extensible and retractable in the cross-machine direction, i.e., the direction perpendicular to the direction the material is moving when it is produced. Upon extension and release, the elastic material provides the force needed for the extended composite to retract. A composite of multiple layers may also be formed in this fashion, either simultaneously or step-wise. As an illustration, to construct a four-layer composite, a layer of a spunbonded nonwoven, another layer of a spunbonded nonwoven, and a meltblown nonwoven material are individually necked by the process detailed above. The layers are then positioned as desired and thermally bonded to an elastomeric meltblown web. The resulting composite is extensible and retractable in at least one direction.

In another embodiment, the composite may be a stretch bonded laminate. A stretch bonded laminate is formed by providing an elastic material, such as a nonwoven web, filaments, or film, extending the elastic material, attaching it to a gatherable material, and releasing the resulting laminate. A stretch bonded laminate is extensible and retractable in the machine direction, i.e. the direction that the material is moving when it is produced. A composite with multiple layers may be formed by providing the elastic layer and the gatherable layers, and subjecting it to this process either simultaneously or stepwise. The stretch bonded laminate may also include a necked material that is extensible and retractable in the cross-direction such that the overall laminate is extensible and retractable in at least two dimensions. As an illustration, to construct a two-layer composite that is extensible and retractable in at least two dimensions, an elastomeric meltblown nonwoven web is provided, the elastomeric meltblown nonwoven web is then extended in the machine direction, and the necked spunbonded nonwoven material is attached to the elastomeric meltblown nonwoven web by thermal bonding while the elastomeric meltblown web is extended. When the biasing force is released, the resulting composite is extensible and retractable in both the cross-direction and machine direction, due to the extensibility of the necked material and the use of the stretch bonding process, respectively.

Additional examples of processes to make such composites are described in, but not limited to, U.S. Pat. No. 5,681,645 to Strack et al., U.S. Pat. No. 5,492,753 to Levy et al., U.S. Pat. No. 4,100,324 to Anderson et al., and in U.S. Pat. No. 5,540,976 to Shawver et al., the contents of which are incorporated herein by reference in their entirety.

The composite may contain various chemical additives or topical chemical treatments in or on one or more layers, including, but not limited to, surfactants, colorants, antistatic chemicals, antifogging chemicals, fluorochemical blood or alcohol repellents, lubricants, or antimicrobial treatments.

Although only a few exemplary embodiments of this invention have been described in detail above, those skilled in the art will readily appreciate that many modifications are possible to the exemplary embodiments without materially departing from the novel teachings and advantages of this invention. Accordingly, all such modifications are intended to be included within the scope of this invention as defined in the following claims.

What is claimed is:

1. A face mask comprising an extensible and retractable mask portion configured to fit over a nose and mouth of a wearer, said mask portion having a percent stretch between about 15 and about 65 percent and a percent recovery of at least about 15 percent, said mask portion contacting at least a portion of the skin of the wearer during use and stretching across at least a portion of the face of the wearer during use, and contracting when removed from the face of the wearer.

2. The face mask as in claim 1, wherein said mask portion is extensible and retractable in two directions.

3. The face mask as in claim 1, wherein the mask portion comprises a material selected from the group consisting of an elastic coform material, an elastic meltblown nonwoven web, a plurality of elastic filaments, an elastic film, and any combination thereof.

4. The face mask as in claim 1, wherein said mask portion is a composite of multiple layers, at least one of said layers being a stretch and recovery layer comprising stretch and recovery material.

5. The face mask as in claim 4, wherein said composite of multiple layers comprises:

an outer layer;

a stretch and recovery layer;

a filtration layer; and an inner layer, wherein said layers are joined in such a manner that said stretch and recovery layer imparts stretch and recovery to said outer layer, said filtration layer, and said inner layer to render said composite of layers extensible and retractable.

6. The face mask as in claim 4, wherein said composite of layers comprises:

an outer layer;

an elastomeric filtration layer having stretch and recovery; and an inner layer, wherein said layers are joined in such a manner that said filtration layer imparts stretch and recovery to said outer and inner layers to render said mask portion extensible and retractable.

7. The face mask as in claim 6, wherein said filtration layer comprises an elastic meltblown nonwoven web.

8. The face mask as in claim 7, wherein said meltblown nonwoven web is an electret.

9. The face mask as in claim 6, wherein said filtration layer comprises an expanded polytetrafluorethylene membrane.

10. The face mask as in claim 1, wherein said mask portion comprises:

an outer layer;

a stretch and recovery layer;

a filtration layer; and an inner layer, wherein said layers are joined in such a manner that said stretch and recovery layer imparts stretch and recovery to said outer layer, said filtration layer, and said inner layer to render said mask portion extensible and retractable.

11. The face mask as in claim 1, wherein said mask portion comprises:

an outer layer;

an elastomeric filtration layer having stretch and recovery; and an inner layer, wherein said layers are joined in such a manner that said filtration layer imparts stretch and recovery to said outer and inner layers to render said mask portion extensible and retractable.

12. The face mask as in claim 11, wherein said filtration layer comprises an elastic meltblown nonwoven web.

13. The face mask as in claim 11, wherein said filtration layer is an electret.

14. The face mask as in claim 11, wherein said filtration layer comprises an expanded polytetrafluorethylene membrane.

15. An extensible and retractable face mask composite, comprising:

an outer layer;

a stretch and recovery layer;

a filtration layer; and an inner layer, wherein said layers are joined in such a manner that said stretch and recovery layer imparts stretch and recovery to said composite rendering said composite extensible and retractable, and wherein said stretch and recovery layer has a percent stretch between about 15 and about 65 percent and a percent recovery of at least about 15 percent.

16. An extensible and retractable face mask composite, comprising:

an outer layer;

an elastomeric filtration layer having stretch and recovery; and an inner layer;

wherein said layers are joined in such a manner that said filtration layer imparts stretch and recovery to said outer and inner layers to render said composite extensible and retractable, wherein said elastomeric filtration layer having a percent stretch between about 15 and about 65 percent and a percent recovery of at least about 15 percent.

17. The composite as in claim 16, wherein said filtration layer comprises an elastic meltblown nonwoven web.

18. The composite as in claim 17, wherein said meltblown nonwoven web is an electret.

19. The composite as in claim 16, wherein said filtration layer comprises an expanded polytetrafluorethylene membrane.

20. The composite as in claim 16, wherein said filtration layer comprises a material selected from the group consisting of an elastic coform material, an elastic meltblown nonwoven web, a plurality of elastic filaments, an elastic film, and a combination thereof.

* * * * *